US006016973A

United States Patent [19]

Thompson et al.

[11] Patent Number: 6,016,973

[45] Date of Patent: Jan. 25, 2000

[54] CLEANER/RINSE DISPENSING DEVICE FOR CARPET CLEANING MECHANISM

[75] Inventors: Frederick D. Thompson, Maryland Heights, Mo.; Steven R. Brandt, Everett; Eric K. Jacobson, Langley, both of Wash.

[73] Assignee: Carpet Co-op of America Association, Maryland Heights, Mo.

[21] Appl. No.: 09/090,297

[22] Filed: Jun. 3, 1998

Related U.S. Application Data

[60] Provisional application No. 60/052,866, Jul. 17, 1997.

[51] Int. Cl.[7] ..... A62C 13/62

[52] U.S. Cl. ..... 239/304; 239/305; 134/21; 134/36; 134/94.1; 15/320

[58] Field of Search ..... 239/304, 305; 134/21, 36, 94.1; 15/320

[56] References Cited

U.S. PATENT DOCUMENTS

| | | | |
|---|---|---|---|
| 4,154,578 | 5/1979 | Bane | 134/21 |
| 4,284,127 | 8/1981 | Collier et al. | 15/321 |
| 4,692,959 | 9/1987 | Monson . | |
| 5,180,439 | 1/1993 | Allison | 134/21 |
| 5,587,021 | 12/1996 | Hoersch et al. | 15/320 |
| 5,593,091 | 1/1997 | Harris | 239/304 |
| 5,871,152 | 2/1999 | Saney | 239/305 |

*Primary Examiner*—Kevin Shaver
*Assistant Examiner*—David Deal
*Attorney, Agent, or Firm*—Blackwell Sanders Peper Martin

[57] ABSTRACT

A system for dispensing an alkaline liquid cleaner solution and an acidic liquid rinse solution via a rotating head on a carpet cleaning machine, wherein the flow of the liquid cleaner solution and the liquid rinse solution are metered such that the rinse solution neutralizes the alkaline cleaner solution and leaves the carpet chemically neutral and residue-free.

4 Claims, 7 Drawing Sheets

CLEANER/RINSE DISPENSING DEVICE FOR CARPET CLEANING MECHANISM

This application claims benefit of provisional applicaiton Ser. No. 60/052,866 filed Jul. 17, 1997.

BACKGROUND OF THE INVENTION

1. Field of Invention

This invention relates to a cleaner/scrubber mechanism primarily for use on carpeting or the like, and, more particularly, for a device for selectively dispensing an alkaline liquid cleaner solution and an acidic liquid rinse solution via a rotating head on a carpet cleaning mechanism. The flows of the liquid cleaner solution and the liquid rinse solution are metered such that the acid rinse solution neutralizes the alkaline cleaner solution and leaves the carpet residue-free.

2. Related Art

Surface cleaning and polishing machines are well-known in the industry. In the past manufacturers have attempted to combine, mechanically and functionally, liquid spraying of a cleaning solution, scrubbing the surface and vacuuming the residue. The designers of these machines attempt to combine the various operations and the structure which performs these operations in a manner which makes the operation efficient while maintaining the other desirable aspects of low price, ease of use and manufacture and durability. Examples of related art include U.S. Pat. Nos. 4,692,959, 4,441,229, 4,339,840, 4,333,204 and 4,264,999.

A significant disadvantage of the above-listed patents is that, although the cleaning solution is rinsed out of the carpet, due to the alkalinity of the cleaning solution, often a slight residue remains in the carpet. This residue, however little in quantity, tends to attract dirt, causing the carpet to become soiled more quickly after cleaning. The residue might also irritate individuals that are sensitive to the cleaners. It would be preferable that the remaining residue be avoided so as to achieve yet a higher degree of carpet cleanliness when using machines and systems of the foregoing type.

The present device is used in conjunction with a carpet cleaning system or machine and is used to provide metered cleaning and rinsing solutions, so that after the cleaning solution is applied, the amount of rinsing solution applied neutralizes the alkaline cleaner and rinses out the residual cleaner. The device can be attached to the carpet cleaning machine by mounting the dispensing device on the machine, or the device can be remote from the mechanism of such a carpet cleaning machine, but in fluid communication with the carpet cleaning machine.

SUMMARY OF THE INVENTION

Among the several advantages, objects and other features of the invention may be noted the provision of a device or system for use with a carpet cleaning machine for allowing neutralization of cleaning solutions dispensed during operation of such machines, which system allows selective application of a neutralizing solution during operation of the machine in order to reduce or eliminate residual pH imbalance which may be caused by such cleaning solutions, or the residue left by them; which system can be very effectively combined and integrated with such a carpet cleaning machine; which allows selective switching between dispensing cleaning solution or neutralizing solution; which does not require redesign of an existing carpet cleaning machine; which is readily used even by relatively unskilled or new users without difficulty; which is relatively simply and easily added to an existing type of carpet cleaning machine without requiring complete redesign of such machine; and which is of economical, long-lasting and reliable nature.

The present invention is a device or system for use in conjunction with a carpet cleaning machine for dispensing an alkaline liquid cleaning solution and an acidic liquid rinsing solution. The device has a water source; a first container containing the liquid cleaner solution and a second container containing the liquid rinse solution; a first metering device that is in fluid communication with the first container and the water source and meters out the water and clean mixture to a cleaning head; a second metering device that is in fluid communication with the second container and the water source and meters out the water and rinse mixture to the cleaning head; a first switching device in fluid communication with the water source and the first metering means; a second switching device in fluid communication between the water source and the second metering; wherein when the first switching device is activated, water enters the first metering device and is contacted with the cleaning solution from the first container and a metered amount of a mixture of cleaning solution and water is directed to the cleaning head; wherein when the second switching device is activated, water enters the second metering device and is contacted with the rinsing solution from the second container and a metered amount of a mixture of rinsing solution and water is directed to the cleaning head, and wherein the metered amounts of cleaning solution and rinsing solution are such that the alkaline cleaning solution is neutralized by the acidic rinsing solution.

As used herein the term cleaner/rinse dispensing device connotes a system of the present invention, and the term carpet cleaning mechanism connotes a carpet cleaning machine using and/or equipped with such device or system.

BRIEF DESCRIPTION OF DRAWINGS

Corresponding reference characters identify corresponding elements throughout the several views of the drawings.

DESCRIPTION OF INVENTIVE EMBODIMENTS

Figure 1:
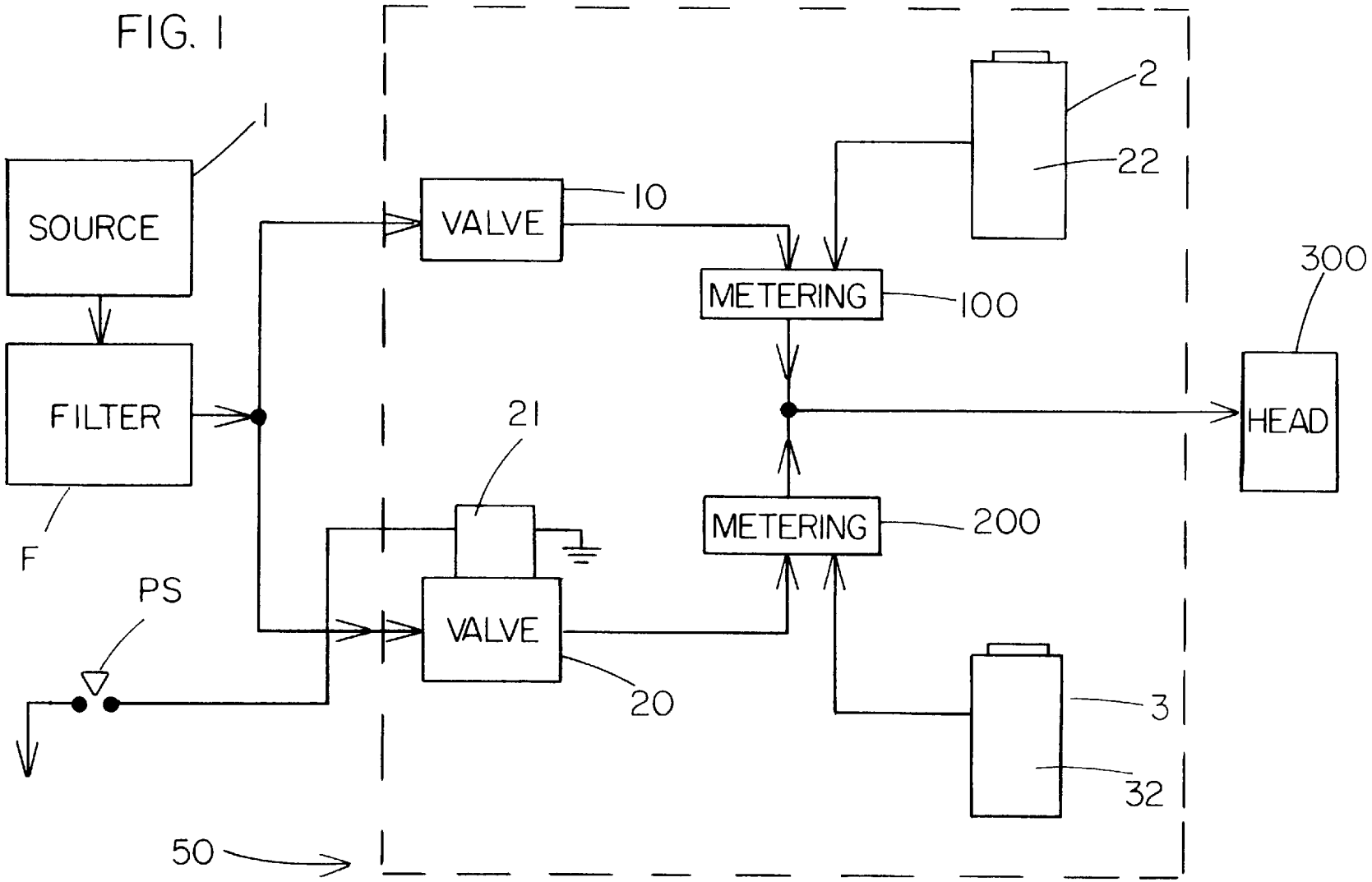
FIG. 1 is a diagram of the new device or system constructed in accordance with and embodying the present invention.

Referring to the drawings, the water source 1 is any means that can provide water to the dispensing device, such as a tank, faucet, barrel or any other water-tight container. The preferred water source is a tank that provides heated water under pressure, such as in a proposed commercial system having a truck-mounted source of hot water for being provided to a carpet cleaning machine of the presently concerned type, and which may deliver the hot water through an in-line filter *f*.

A carpet cleaning machine of the invention is provided with a first and second container 2 and 3, respectively, which are water-tight reservoirs, compatible with cleaning solutions or rinsing solutions. The first reservoir 2 contains a cleaning solution 22, and the second container 3 contains a rinse solution 32. Reservoirs 2 and 3 typically have a resealable opening at the top for filling, and have a suitable opening in the bottom, which provide fluid communication with the first and second metering devices 100 and 200, respectively. The preferred reservoirs are plastic or stainless steel metal with resealable tops.

Figure 2:
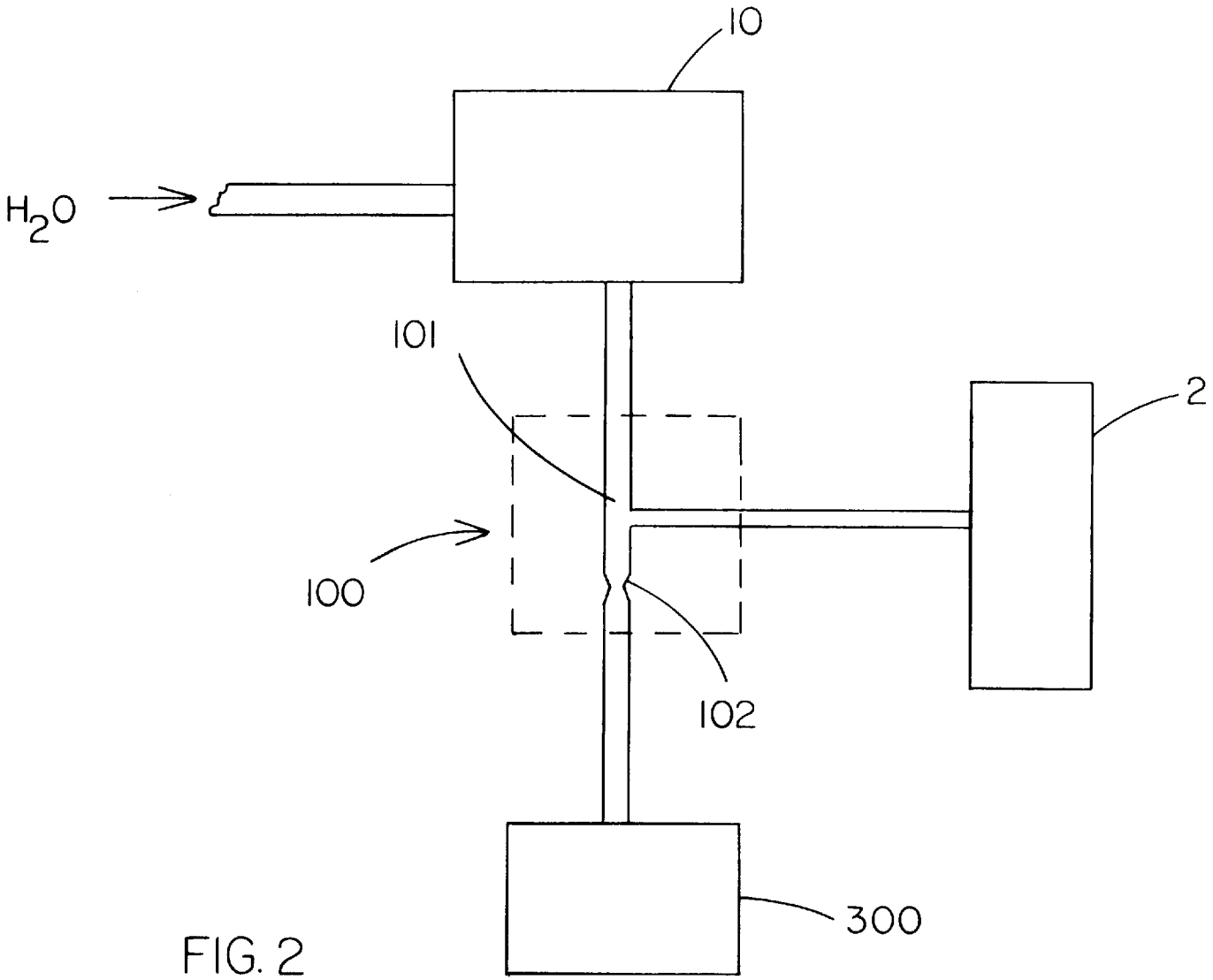
FIG. 2 is a diagram of a cut-away view of a preferred metering device of the system.

The metering devices 100 and 200 are any means that can mix two or more liquids and meter the flow out to the cleaning head. Suitable metering devices includes pumps, mechanical mixers and orifices. The preferred metering devices 100 and 200 are metered orifices or injectors that allow the flow of the solutions to be regulated. The most preferred metering device is embodied in FIG. 2, wherein when switching device 10 is activated, allowing water to flow to the metering device 100. A venturi 101 and the second metering means 200 are designed to provide a chemically balanced amount of cleaner 22 and rinse solution 32, so that, upon rinsing, the alkaline cleaner 22 is neutralized by the acidic rinsing solution 32, and all the cleaner residue is essentially removed from the carpet. Suitable alkaline cleaning solutions 22 are typically detergent solutions that are commercially available from sources such as Proctor and Gamble, or Johnson and Johnson. Likewise, suitable acidic rinsing solutions 32 are commercially available from similar sources.

The switching devices 10 and 20 are mechanical valves or electrical valves or fluid switching devices that open and close the fluid communication between the water source 1 and the metering means 100 and 200. The preferred arrangement is that the first switching device 10 is a manually activated valve which allows water and cleaning solution 22 to flow through the first metering means 100, the second switching device 20 being a solenoid valve selectively actuated by a solenoid 21 by a pushbutton switch PS on a handle of a cleaning machine equipped with the new system. Then, when the first switching means 10 is selectively deactivated, the second switching means 20 is activated as desired by pressing pushbutton switch PS, thereby allowing the flow of water and the rinse solution 32 through the second metering means 200.

Typically, the cleaning solution 22 and the rinsing solution 32 are not to be applied simultaneously.

A cleaning head 300 receives flow from either metering device 100 or metering device 200. It is typically a rotating head that applies the cleaning solution and water mixture or the rinsing solution and water mixture directly to the carpet by high pressure jets while head 300 is rotating, so that jets strike the carpet fibers from all directions. Examples of carpet cleaning machines 75 and suitable cleaning heads 300 are disclosed in U.S. Pat. Nos. 4,692,959, 4,441,229, 4,339,840, 4,333,204 and 4,264,999, which are hereby incorporated by reference.

Figure 3:
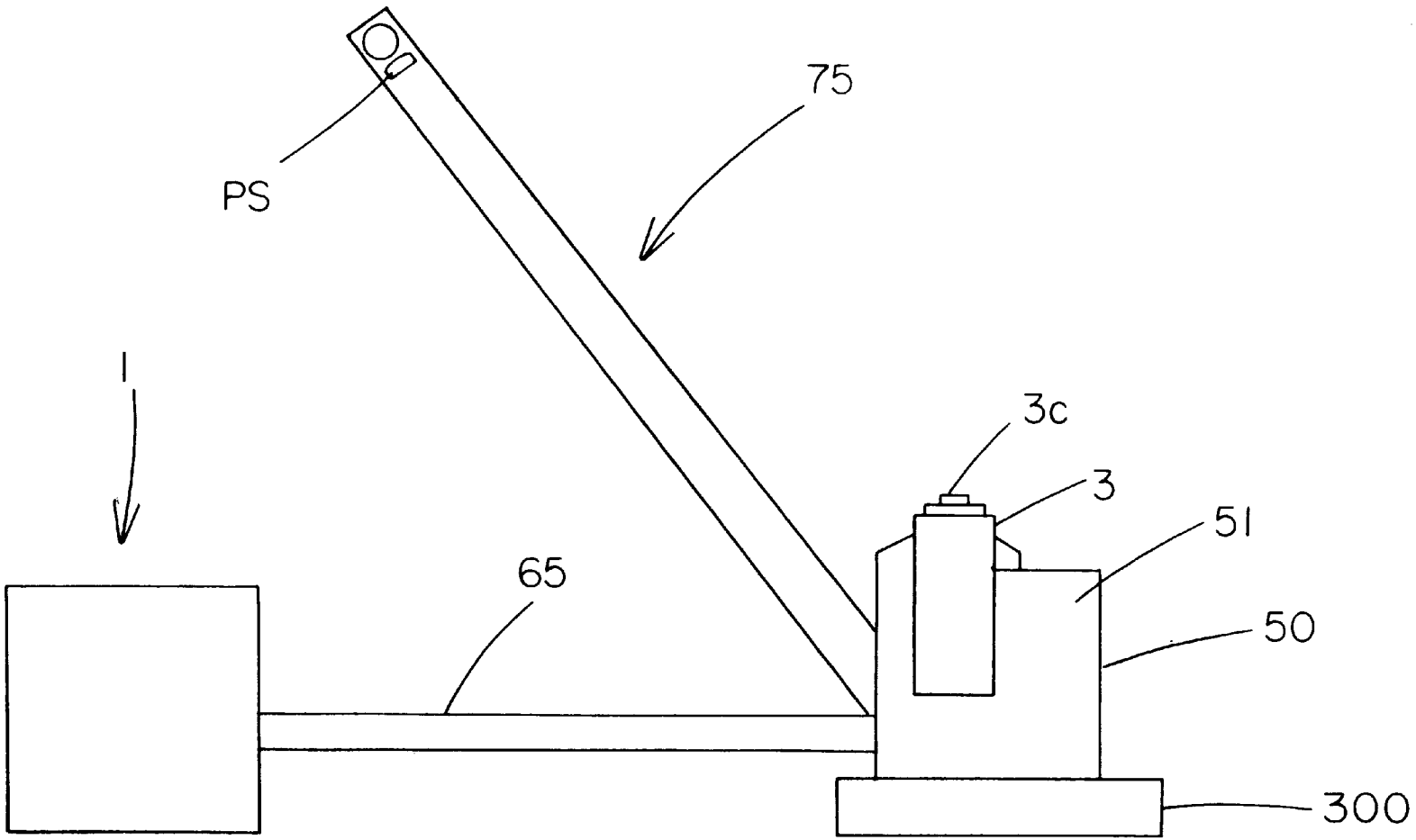
FIG. 3 is a schematic view of the new system mounted on a carpet cleaning machine.

Referring to FIG. 3, which is a simplified view of a carpet cleaning machine 75, the water source 1 (FIG. 1) is a tank separate from carpet cleaning machine 75, and is in fluid communication by an extended flexible hose 65 with the remaining delivery portion 50 of the new system mounted directly on the carpet cleaning machine.

Figure 4:
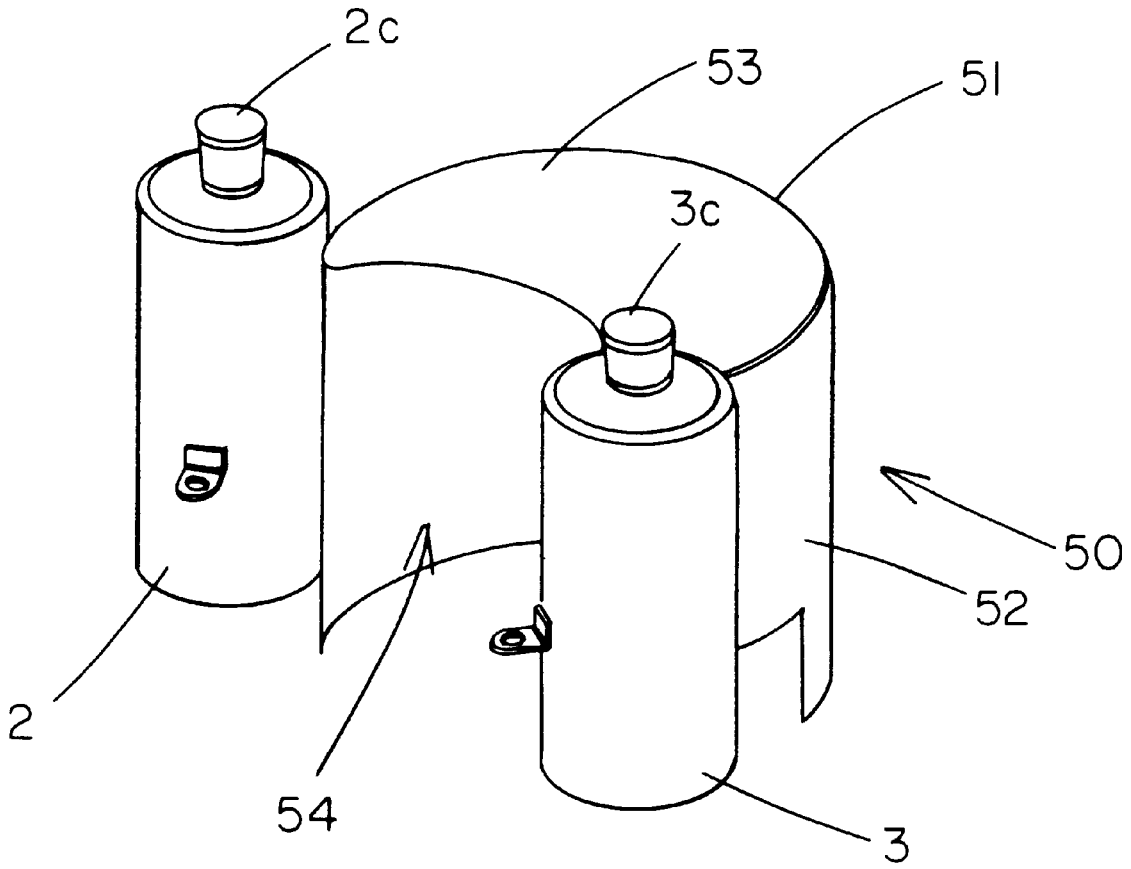
FIG. 4 is a perspective view of housing elements of the new system, for mounting on a carpet cleaning machine.

Referring to FIG. 4, system portion 50 comprises a housing 51 having a semicylindrical outer wall 52 and upper surface 53 to define an interior space 54 in which the above-referenced solenoid valve, metering devices, wiring and fluid connection and other elements are received. Housing 51 may be of stainless steel or synthetic materials. Reservoirs 10 and 11 form part of the assembly, there being filling closures 10*c*, 11*c* atop these cylindrical reservoirs.

Figure 5:
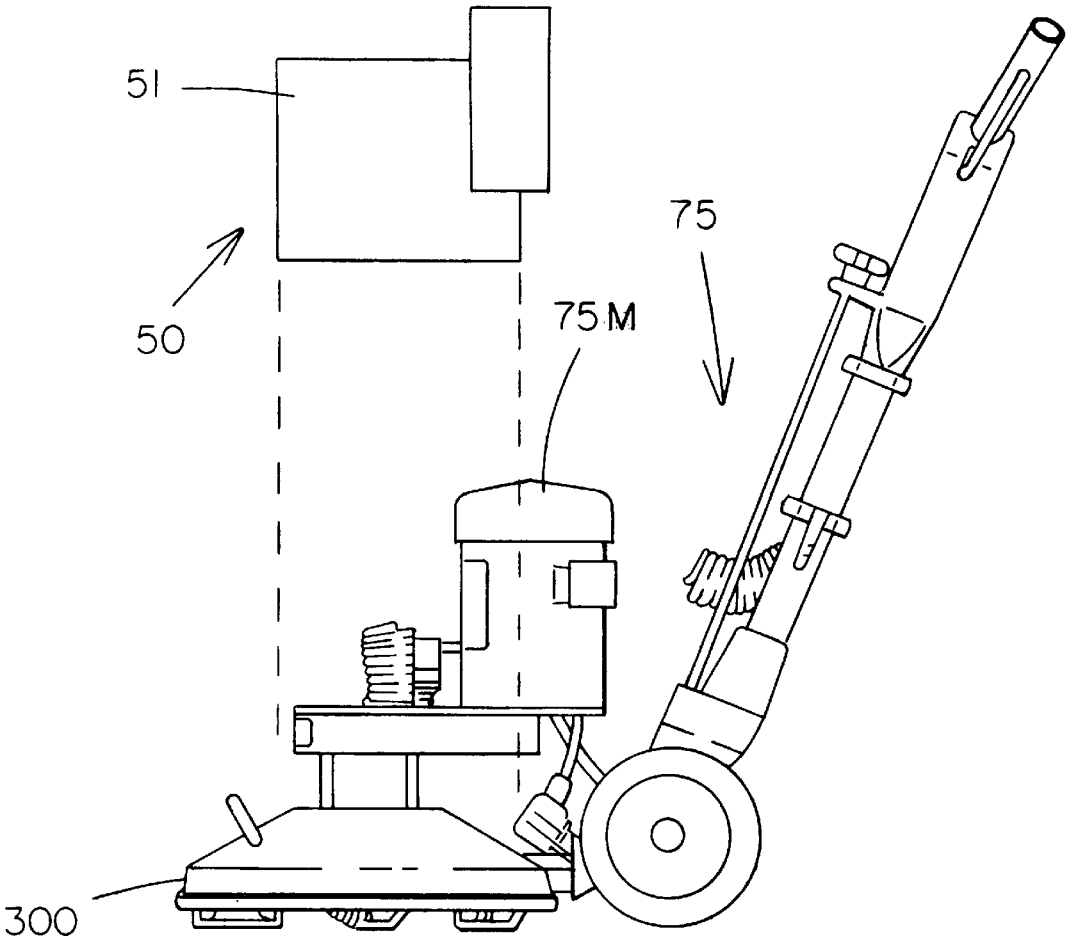
FIG. 5 illustrates such a carpet cleaning machine showing how the housing elements of FIG. 4 are incorporated into the machine.
Figure 6:
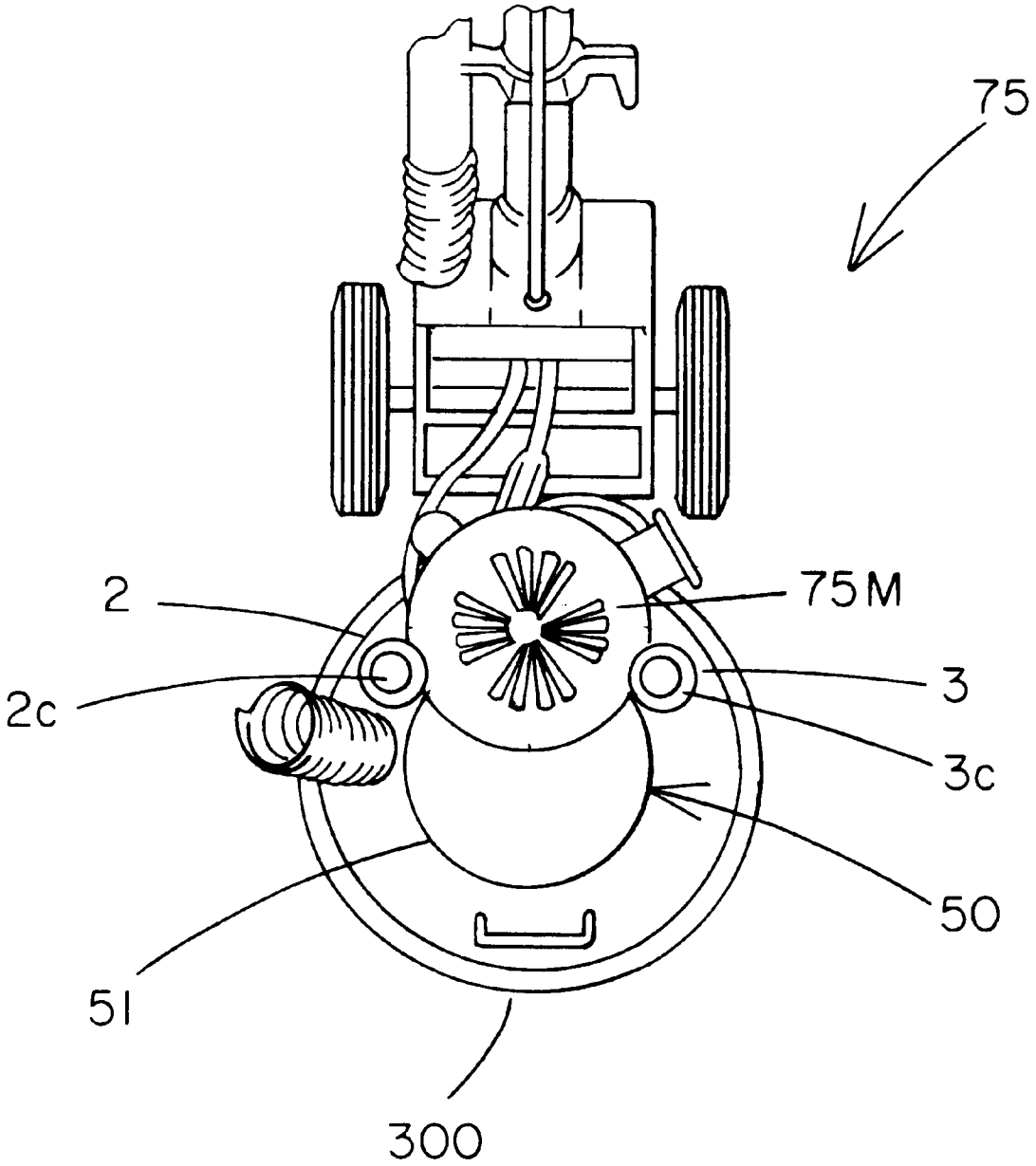
FIG. 6 is a top plan view of the carpet cleaning machine, showing the housing elements in place.
Figure 7:
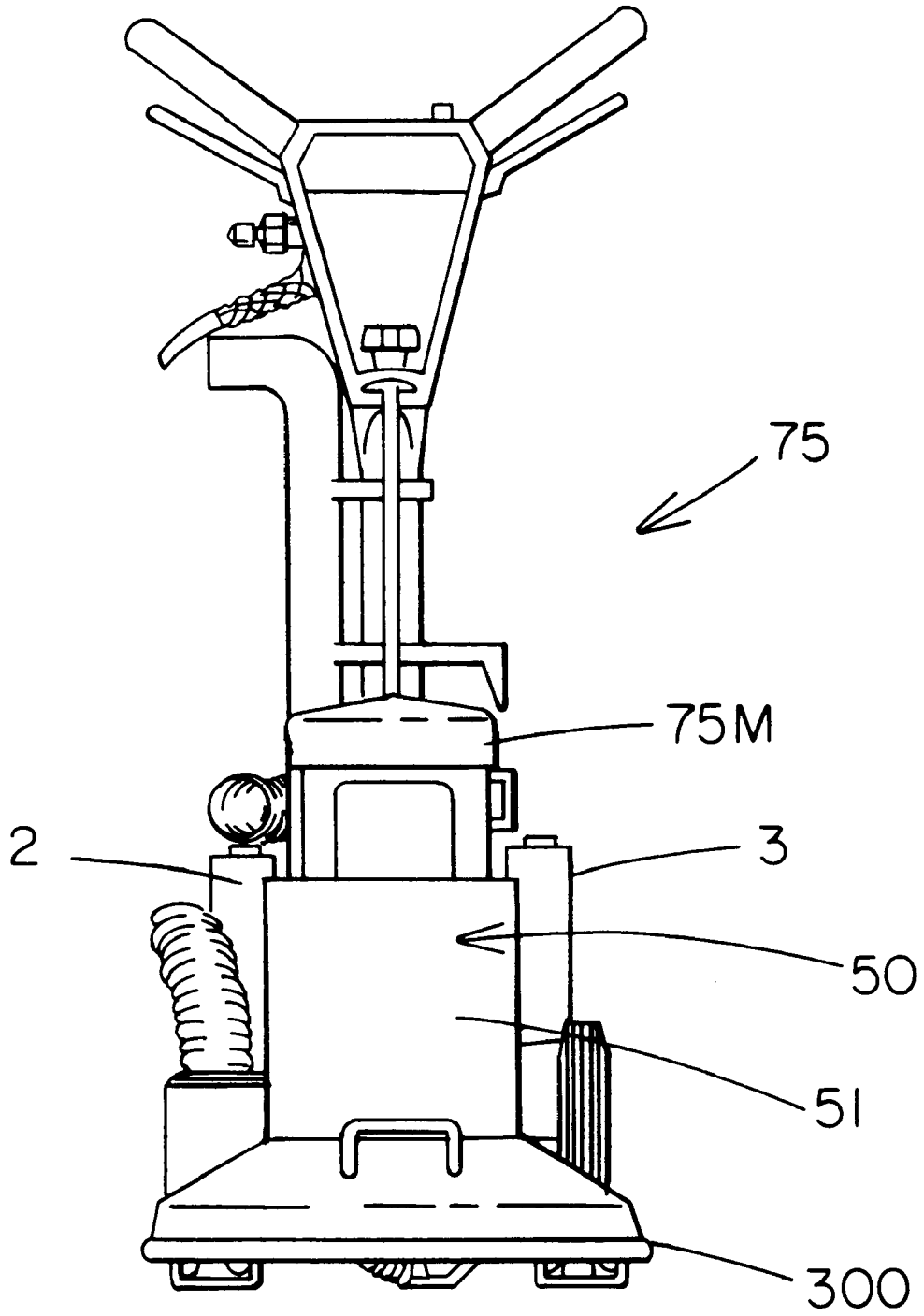
FIG. 7 is a front elevation view of the carpet cleaning machine with the housing elements of the system.

FIGS. 5, 6 and 7 illustrate the manner in which system portion 50 in fitted onto carpet cleaning machine 75 in such manner as to be closely fitted to the motor housing 75 M of the machine.

The embodiment was chosen and described in order to best explain the principles of the invention and its practical application to thereby enable others skilled in the art to best utilize the invention in various embodiments and with various modifications as are suited to the particular use contemplated, particularly the use of more than two cleaning and rinsing solutions or the use of additional solutions.

As various modifications could be made in the construction and methods herein described and illustrated without departing from the scope of the invention, it is intended that all matter contained in the foregoing description or shown in the accompanying drawings shall be interpreted as illustrative rather than limiting.

What is claimed is:

1. A system for use with a carpet cleaning machine for dispensing an alkaline liquid cleaning solution and an acidic liquid rinsing solution comprising:

a water source;

a first metering device in fluid communication with the water source;

a second metering device in fluid communication with the water source;

a switching apparatus in fluid communication with the first metering device for selectively enabling or disabling the first metering device by permitting or prohibiting flow of water to the first metering device;

a rinse control means in fluid communication with the second metering device for selectively causing operation of the second metering device when the first metering device is disabled;

a first reservoir in fluid communication with the first metering device for dispensing a cleaning solution to the first metering device whereupon the first metering device mixes a metered portion of the cleaning solution with water from the water source;

a second reservoir in fluid communication with the second metering device for dispensing a rinsing solution to the second metering device whereupon the second metering device mixes a metered portion of the rinsing solution with water from the water source; and a cleaning head in fluid communication with both the first metering device and the second metering device for applying the cleaning solution or the rinsing solution to a carpet to be cleaned with the system.

2. A system as set forth in claim 1 wherein the rinse control means is a solenoid valve selectively controllable by an operator of the carpet cleaning machine during its usage.

3. The system of claim 1, wherein the switching apparatus comprises a first switching device and a second switching device, the first switching device being in fluid communication with the water source and the first metering device so that when the first switching device is activated, water enters the first metering device and is contacted with the cleaning solution from the first reservoir and a metered amount of a mixture of cleaning solution and water is directed to the cleaning head; and the second switching device being in fluid communication between the water source and the second metering device, so that when the second switching device is activated, water enters the second metering device arid is contacted with the rinsing solution from the second reservoir and a metered amount of a mixture of rinsing solution and water is directed to the cleaning head, and wherein the metered amounts of cleaning solution and rinsing solution are such that the alkaline cleaning solution is neutralized by the acidic rinsing solution.

4. The system of claim 1, wherein the structure of the system can be retrofit to an existing carpet cleaning device.

* * * * *